US005159817A

United States Patent [19]

Hojo et al.

[11] Patent Number: 5,159,817

[45] Date of Patent: Nov. 3, 1992

[54] REFRIGERANT PATH APPARATUS

[75] Inventors: Toshiyuki Hojo, Shimizu; Kenji Tokusa, Shizuoka; Kensaku Oguni, Shimizu; Susumu Nakayama, Shizuoka, all of Japan

[73] Assignee: Hitachi, Ltd., Tokyo, Japan

[21] Appl. No.: 795,737

[22] Filed: Nov. 21, 1991

[30] Foreign Application Priority Data

Nov. 21, 1990 [JP] Japan ..... 2-316760

[51] Int. Cl.[5] ..... F25B 13/00

[52] U.S. Cl. ..... 62/81; 62/199; 62/278

[58] Field of Search ..... 62/81, 278, 199, 8

[56] References Cited

U.S. PATENT DOCUMENTS

| | | | |
|---|---|---|---|
| 4,122,686 | 10/1978 | Lindahl | 62/81 |
| 4,854,130 | 8/1989 | Naruse | 62/278 X |
| 4,949,551 | 8/1990 | Gregory | 62/278 X |
| 5,107,684 | 4/1992 | Nakayama et al. | 62/81 |

FOREIGN PATENT DOCUMENTS 2223776 9/1990 Japan .

*Primary Examiner*—Alan Cohan

*Attorney, Agent, or Firm*—Antonelli, Terry, Stout & Kraus

[57] ABSTRACT

A method for controlling a refrigerant path apparatus including a pressurized gas refrigerant path for a flow of a pressurized gas refrigerant which has not been substantially cooled to be liquefied, a pressurized liquid refrigerant path for a flow of a pressurized liquid refrigerant which is generated from the pressurized gas refrigerant by being cooled to be liquefied, a first heat exchanger means which is fluidly connected to the pressurized gas refrigerant path to supply the pressurized gas refrigerant into the first heat exchanger so that a heat exchange is carried out between the pressurized gas refrigerant in the first heat exchanger and the outside of the first heat exchanger, comprises the steps of allowing a flow of the refrigerant from the pressurized gas refrigerant path to the pressurized liquid refrigerant path when a supply of the pressurized gas refrigerant from the pressurized gas refrigerant path into the first heat exchanger means is prevented, and preventing the flow of the refrigerant from the pressurized gas refrigerant path to the pressurized liquid refrigerant path when the supply of the pressurized gas refrigerant form the pressurized gas refrigerant path into the first heat exchanger means is allowed.

20 Claims, 8 Drawing Sheets

REFRIGERANT PATH APPARATUS

BACKGROUND OF THE INVENTION AND RELATED ART STATEMENT

The present invention relates to a refrigerant path apparatus used in a air-conditioning system.

As shown in Japanese Patent Unexamined Publication No. 2-223776, a conventional heat pump system for warming or cooling an air in a room to be air-conditioned, comprises a compressor which takes in a refrigerant through an inlet thereof and discharges the refrigerant through an outlet thereof after the refrigerant is compressed, an adiabatic expansion orifice which includes first and second orifice ends and through which the compressed refrigerant expands adiabatically, a first heat exchanger whose first end is fluidly connected to the outlet of the compressor on a cooling operation for the air-conditioned room and to the inlet of the compressor on a warming operation for the air-conditioned room and whose second end is fluidly connected to the first orifice end, and a second heat exchanger whose first end is fluidly connected to the second orifice end and whose second end is fluidly connected to the inlet of the compressor on the cooling operation and to the outlet of the compressor on the warming operation.

OBJECT AND SUMMARY OF THE INVENTION

An object of the present invention is to provide a refrigerant path apparatus which is used in an air-conditioning system and in which an unnecessary liquefying of the refrigerant is prevented.

A refrigerant path apparatus according to the present invention, comprises, a pressurized gas refrigerant path for a flow of a pressurized gas refrigerant which has not been substantially cooled to be liquefied after the gas of the refrigerant was compressed to be pressurized, a pressurized liquid refrigerant path for a flow of a pressurized liquid refrigerant which has been substantially cooled to be liquefied after the gas of the refrigerant was compressed to be pressurized, a first heat exchanger mans which is fluidly connected to the pressurized gas refrigerant path to supply the pressurized gas refrigerant into the first heat exchanger so that a heat exchange is carried out between the pressurized gas refrigerant in the first heat exchanger and the outside of the first heat exchanger, a first valve means arranged between the first heat exchanger means and the pressurized gas refrigerant path to control the supply of the pressurized gas refrigerant into the first heat exchanger mans, and a second valve means arranged between the pressurized gas refrigerant path and the pressurized liquid refrigerant path to allow a flow of the refrigerant from the pressurized gas refrigerant path to the pressurized liquid refrigerant path when the first valve means prevents the supply of the pressurized gas refrigerant from the pressurized gas refrigerant path into the first heat exchanger mans.

A method for controlling a refrigerant path apparatus including a pressurized gas refrigerant path for a flow of a pressurized gas refrigerant which has not been substantially cooled to be liquefied after the gas of the refrigerant was compressed to be pressurized, a pressurized liquid refrigerant path for a flow of a pressurized liquid refrigerant which has been substantially cooled to be liquefied after the gas of the refrigerant was compressed to be pressurized, and a first heat exchanger means which is fluidly connected to the pressurized gas refrigerant path to supply the pressurized gas refrigerant into the first heat exchanger so that a heat exchange is carried out between the pressurized gas refrigerant in the first heat exchanger and the outside of the first heat exchanger, comprises the steps of allowing a flow of the refrigerant from the pressurized gas refrigerant path to the pressurized liquid refrigerant path when a supply of the pressurized gas refrigerant from the pressurized gas refrigerant path into the first heat exchanger means is prevented, and preventing the flow of the refrigerant from the pressurized gas refrigerant path to the pressurized liquid refrigerant path when the supply of the pressurized gas refrigerant from the pressurized gas refrigerant path into the first heat exchanger means is allowed.

According to the present invention, since the flow of the refrigerant from the pressurized gas refrigerant path to the pressurized liquid refrigerant path is allowed when the supply of the pressurized gas refrigerant from the pressurized gas refrigerant path into the first heat exchanger means is prevented, the flow of the refrigerant in the pressurized gas refrigerant path is maintained to prevent the refrigerant in the pressurized gas refrigerant path from being cooled to be liquefied. Since a flow rate for preventing the refrigerant in the pressurized gas refrigerant path from being liquefied may be small, the flow of the refrigerant from the pressurized gas refrigerant path to the pressurized liquid refrigerant path does not generate a significant problem.

DETAILED DESCRIPTION OF PREFERRED EMBODIMENTS

Figure 1:
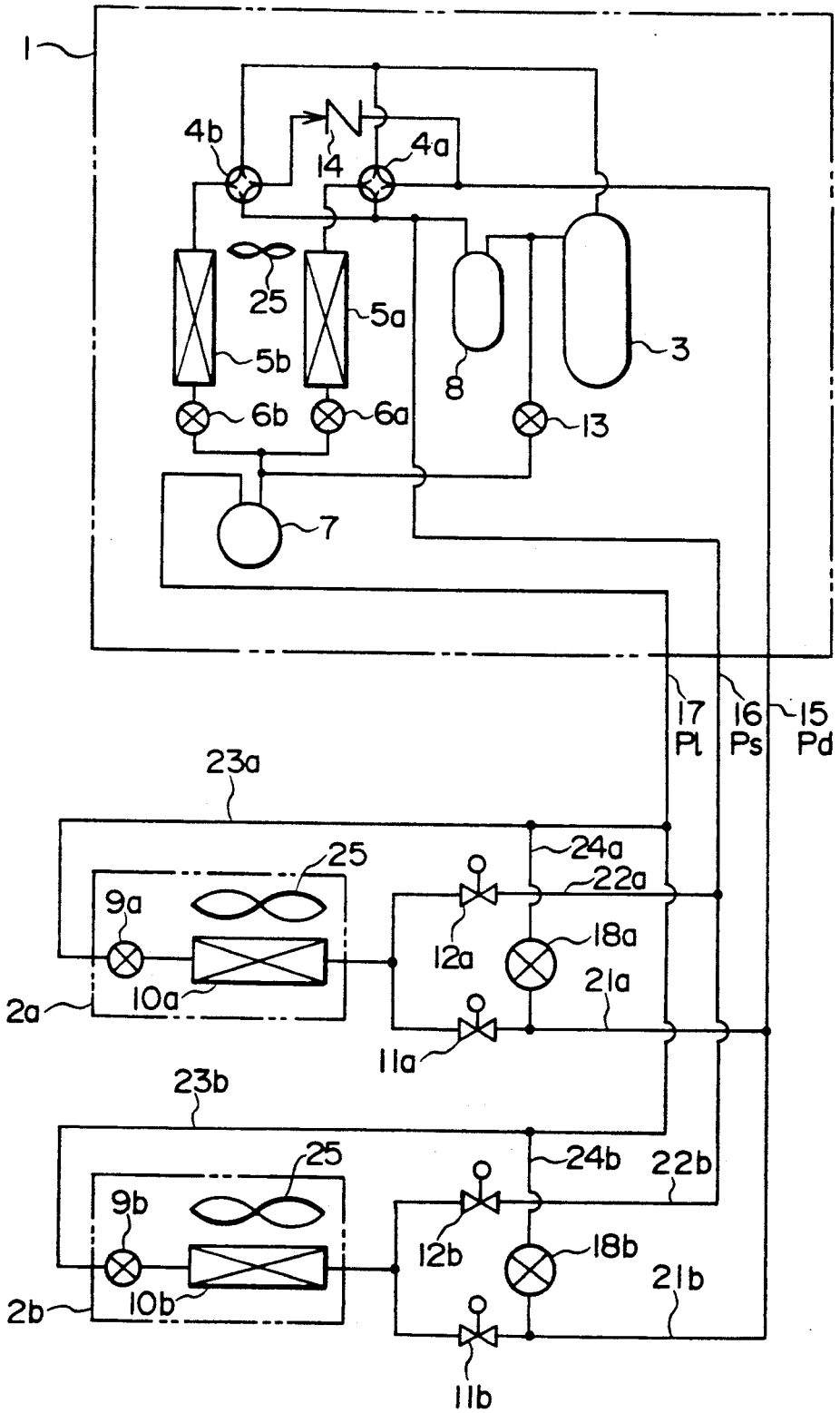
FIG. 1 is a schematic view showing an embodiment of the present invention.

As shown in FIG. 1, in an embodiment of the present invention, a pressurized gas refrigerant which has not been substantially cooled by any of first heat exchangers 5*a* and 5*b* and second heat exchangers 10*a* and 10*b* after the pressurized gas refrigerant was discharged from an outlet of a compressor 3 is supplied to a pressurized gas refrigerant path 15, a pressurized liquid refrigerant which is generated by cooling the pressurized gas refrigerant to be liquefied in any of the first heat exchangers 5*a* and 5*b* and the second heat exchangers 10*a* and 10*b* is supplied to a pressurized liquid refrigerant path 17, a depressurized gas refrigerant which is generated by making the pressurized liquid refrigerant pass through any of adiabatic expansion orifices 6a, 6b, 9a, 9b for an adiabatic expansion of the pressurized liquid refrigerant, and a depressurized heated gas refrigerant which is generated by heating the depressurized gas refrigerant in any of the first heat exchangers 5a and 5b and the second heat exchangers 10a and 10b is supplied to a depressurized heated gas refrigerant path 16. Any of the first heat exchangers 5a and 5b may be used as an indoor heat exchanger or an outdoor heat exchanger, and any of the second heat exchangers 10a and 10b may be used as the indoor heat exchanger or the outdoor heat exchanger.

Preferably, the first heat exchangers 5a and 5b are used as the outdoor heat exchanger, and the second heat exchangers 10a and 10b are used as the indoor heat exchanger, when the first heat exchangers 5a and 5b and the compressor 3 are received by an outdoor unit 1 accommodating the adiabatic expansion orifices 6a, 6b, a fan 25 for accelerating a heat exchange between the refrigerant in the first heat exchangers 5a and 5b and the outside thereof, a receiver 7 arranged between the adiabatic expansion orifices 6a, 6b and the adiabatic expansion orifices 9a, 9b for storing the pressurized liquid refrigerant, an adiabatic expansion bypass valve 13 which opens slightly to allow a significantly small flow of the pressurized liquid refrigerant from the pressurized liquid refrigerant path 17 to an inlet of the compressor 3 when the compressor 3 needs to be cooled by the depressurized gas refrigerant generated through the adiabatic expansion bypass valve 13, an accumulator 8 fluidly connected to the inlet of the compressor 3 for storing the depressurized heated gas refrigerant to be taken from the depressurized heated gas refrigerant path 16 into the inlet of the compressor 3, four-ports two-positions flow direction control valves 4a, 4b connected fluidly to the first heat exchangers 5a and 5b respectively, in whose one position the pressurized gas refrigerant is supplied from the outlet of the compressor 3 to the respective first heat exchangers 5a and 5b and the depressurized heated gas refrigerant is supplied from the depressurized heated gas refrigerant path 16 to the inlet of the compressor 3 and in whose another position the pressurized gas refrigerant is supplied from the outlet of the compressor 3 to the pressurized gas refrigerant path 15 and the depressurized heated gas refrigerant is supplied from the respective first heat exchangers 5a and 5b to the inlet of the compressor 3, and an one-way valve 14 for preventing a pressurized gas refrigerant flow from the pressurized gas refrigerant path 15 to the flow direction control valves 4b and allowing the pressurized gas refrigerant flow from the flow direction control valves 4b to the pressurized gas refrigerant path 15. When the control valves 4a, 4b form respective fluidal connections as shown by solid lines in FIG. 1, the orifice 6a is closed to prevent a refrigerant flow from the first heat exchanger 5a to the control valve 4a.

When any of the first heat exchangers 5a and 5b operates to heat the depressurized gas refrigerant and any of the second heat exchangers 10a and 10b operates to cool the pressurized gas refrigerant to supply the pressurized liquid refrigerant to the any of the adiabatic expansion orifices 6a, 6b, 9a, 9b, any of the adiabatic expansion orifices 6a, 6b fluidly connected to the any of the first heat exchangers 5a and 5b operating to heat the depressurized gas refrigerant opens slightly to effect an adiabatic expansion and any of the adiabatic expansion orifices 9a, 9b fluidly connected to the any of the second heat exchangers 10a and 10b operating to cool the pressurized gas refrigerant opens largely not to form a large flow resistance. When any of the first heat exchangers 5a and 5b operates to cool the pressurized gas refrigerant to supply the pressurized liquid refrigerant to the any of the adiabatic expansion orifices 6a, 6b, 9a, 9b and any of the second heat exchangers 10a and 10b operates to heat the depressurized gas refrigerant, any of the adiabatic expansion orifices 6a, 6b fluidly connected to the any of the first heat exchangers 5a and 5b operating to cool the pressurized gas refrigerant opens largely not to form the large flow resistance and any of the adiabatic expansion orifices 9a, 9b fluidly connected to the any of the second heat exchangers 10a and 10b operating to heat the depressurized gas refrigerant opens slightly to effect the adiabatic expansion. Therefore, the pressurized liquid refrigerant always exists at least between the adiabatic expansion orifices 6a, 6b and the adiabatic expansion orifices 9a, 9b.

An indoor unit 2a accommodates the second heat exchanger 10a, the adiabatic expansion orifice 9a and a fan 25 for accelerating a heat exchange between the refrigerant in the second heat exchanger 10a and the outside thereof. An indoor unit 2b accommodates the second heat exchanger 10b, the adiabatic expansion orifice 9b and a fan 25 for accelerating a heat exchange between the refrigerant in the second heat exchanger 10b and the outside thereof.

The pressurized liquid refrigerant path 17 is connected to one end of the second heat exchanger 10a through the adiabatic expansion orifice 9a and a pressurized liquid refrigerant path branch 23a, the depressurized heated gas refrigerant path 16 is connected to another end of the second heat exchanger 10a through a depressurized heated gas refrigerant path branch 22a and a third valve 12a, and the pressurized gas refrigerant path 15 is connected to the another end of the second heat exchanger 10a through a pressurized gas refrigerant path branch 21a and a first valve 11a. The pressurized gas refrigerant path branch 21a is connected to the pressurized liquid refrigerant path branch 23a by a bypass 24a and a second valve 18a which can allow a slight flow of the refrigerant from the pressurized gas refrigerant path branch 21a to the pressurized liquid refrigerant path branch 23a through the bypass 24a when the first valve 11a prevents the refrigerant from flowing from the pressurized gas refrigerant path 15 to the second heat exchanger 10a.

When the second heat exchanger 10a operates to cool the outside thereof, the first valve 11a is closed to prevent the pressurized gas refrigerant from flowing from the pressurized gas refrigerant path 15 to the second heat exchanger 10a, the third valve 12a opens to allow the depressurized heated refrigerant to flow from the second heat exchanger 10a to the depressurized heated gas refrigerant path branch 22a, and the adiabatic expansion orifice 9a opens slightly to generate the depressurized gas refrigerant from the pressurized liquid refrigerant for cooling the outside of the second heat exchanger 10a. If there is a possibility that the pressurized gas refrigerant in the pressurized gas refrigerant path 15 and/or the pressurized gas refrigerant path branch 21a is cooled to be liquefied, or if a change from the pressurized gas refrigerant to the pressurized liquid refrigerant is detected in the pressurized gas refrigerant path 15 and/or the pressurized gas refrigerant path branch 21*a*, the second valve 18*a* allows the slight flow of the refrigerant from the pressurized gas refrigerant path branch 21*a* to the pressurized liquid refrigerant path branch 23*a* so that the refrigerant in the pressurized gas refrigerant path branch 21*a* and/or the pressurized gas refrigerant path 15 can be heated by the pressurized gas refrigerant supplied from the compressor 3 to prevent the liquefying of the refrigerant in the pressurized gas refrigerant path branch 21*a* and/or the pressurized gas refrigerant path 15.

When the second heat exchanger 10*a* operates to heat the outside thereof, the first valve 11*a* is opened to allow the pressurized gas refrigerant from flowing from the pressurized gas refrigerant path 15 to the second heat exchanger 10*a*, the third valve 12*a* is closed to prevent the refrigerant from flowing from the second heat exchanger 10*a* to the depressurized heated gas refrigerant path branch 22*a*, and the adiabatic expansion orifice 9*a* opens largely not to form the large refrigerant flow resistance from the second heat exchanger 10*a* to the pressurized liquid refrigerant path branch 23*a*. Since a pressure in the depressurized heated gas refrigerant path 16 and the depressurized heated gas refrigerant path branch 22*a* is low, the refrigerant therein the vaporized to prevent the liquefying of the refrigerant therein.

When the second heat exchanger 10*a* stops to heat or cool the outside thereof, the first valve *a* is closed to prevent the pressurized gas refrigerant from flowing from the pressurized gas refrigerant path 15 to the second heat exchanger 10*a*, the third valve 12*a* opens to allow the refrigerant to flow from the second heat exchanger 10*a* to the depressurized heated gas refrigerant path branch 22*a*, and the adiabatic expansion orifice 9*a* is closed to prevent the refrigerant from flowing between the second heat exchanger 10*a* and the pressurized liquid refrigerant path branch 23*a*. If there is a possibility that the pressurized gas refrigerant in the pressurized gas refrigerant path 15 and/or the pressurized gas refrigerant path branch 21*a* is cooled to be liquefied, or if a change from the pressurized gas refrigerant to the pressurized liquid refrigerant is detected in the pressurized gas refrigerant path 15 and/or the pressurized gas refrigerant path branch 21*a*, the second valve 18*a* allows the slight flow of the refrigerant from the pressurized gas refrigerant path branch 21*a* to the pressurized liquid refrigerant path branch 23*a* so that the refrigerant in the pressurized gas refrigerant path branch 21*a* and/or the pressurized gas refrigerant path 15 can be heated by the pressurized gas refrigerant supplied from the compressor 3 to prevent the liquefying of the refrigerant in the pressurized gas refrigerant path branch 21*a* and/or the pressurized gas refrigerant path 15. Since the third valve 12*a* is opening, the refrigerant in the second heat exchanger 10*a* is vaporized by a pressure in the depressurized heated gas refrigerant path 16 to prevent the liquefying of the refrigerant in the depressurized heated gas refrigerant path 16, the depressurized heated gas refrigerant path branch 22*a* and the second heat exchanger 10*a*. The second valve 18*a* may be directly connected to the pressurized liquid refrigerant path 17 with deletion of the bypass 24*a*.

Generally, in heat pump systems, a pressure Pd in the pressurized gas refrigerant path 15 is slightly higher than a pressure P1 in the pressurized liquid refrigerant path 17, and the pressure P1 in the pressurized liquid refrigerant path 17 is significantly higher than a pressure Ps in the depressurized heated gas refrigerant path 16.

The pressurized liquid refrigerant path 17 is connected to one end of the second heat exchanger 10*b* through the adiabatic expansion orifice 9*b* and a pressurized liquid refrigerant path branch 23*b*, the depressurized heated gas refrigerant path 16 is connected to another end of the second heat exchanger 10*b* through a depressurized heated gas refrigerant path branch 22*b* and a third valve 12*b*, and the pressurized gas refrigerant path 15 is connected to the another end of the second heat exchanger 10*b* through a pressurized gas refrigerant path branch 21*b* and a first valve 11*b*. The pressurized gas refrigerant path branch 21*b* is connected to the pressurized liquid refrigerant path branch 23*b* by a bypass 24*b* and a second valve 18*b* which can allow a slight flow of the refrigerant from the pressurized gas refrigerant path branch 21*b* to the pressurized liquid refrigerant path branch 23*b* through the bypass 24*b* when the first valve 11*b* prevents the refrigerant from flowing from the pressurized gas refrigerant path 15 to the second heat exchanger 10*b*. Operations of the second heat exchanger 10*b*, the adiabatic expansion orifice 9*b*, the third valve 12*b*, the second valve 18*b* and the first valve 11*b* are controlled respectively in the same ways as the second heat exchanger 10*a*, the adiabatic expansion orifice 9*a*, the third valve 12*a*, the second valve 18*a* and the first valve 11*a*.

Figure 2:
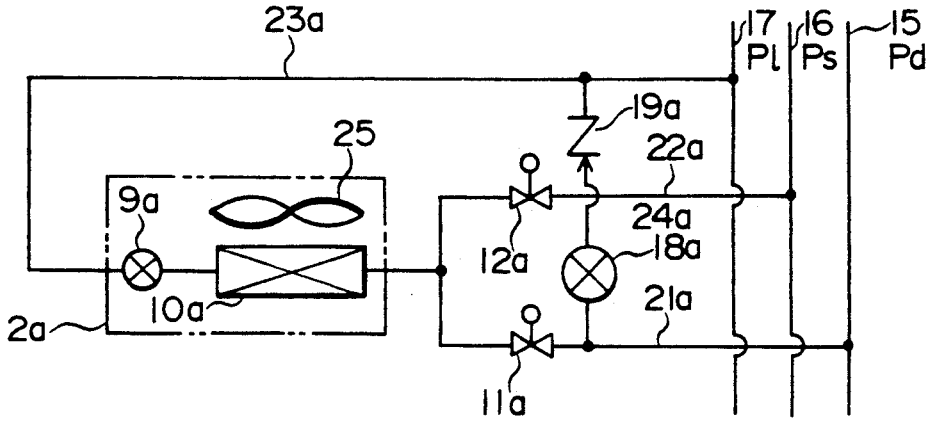
FIG. 2 is a schematic view showing an embodiment of the present invention.

As shown in FIG. 2, an one-way flow valve 19*a* may be arranged between the pressurized gas refrigerant path branch 21*a* and the pressurized liquid refrigerant path branch 23*a* to prevent a refrigerant flow from the pressurized liquid refrigerant path branch 23*a* to the pressurized gas refrigerant path branch 21*a* and to allow a refrigerant flow from the pressurized gas refrigerant path branch 21*a* to the pressurized liquid refrigerant path branch 23*a*. Alternatively, a pump 19*a* for feeding compulsorily the refrigerant from the pressurized gas refrigerant path branch 21*a* to the pressurized liquid refrigerant path branch 23*a* and preventing the refrigerant flow from the pressurized liquid refrigerant path branch 23*a* to the pressurized gas refrigerant path branch 21*a* may be arranged between the pressurized gas refrigerant path branch 21*a* and the pressurized liquid refrigerant path branch 23*a*.

Figure 3:
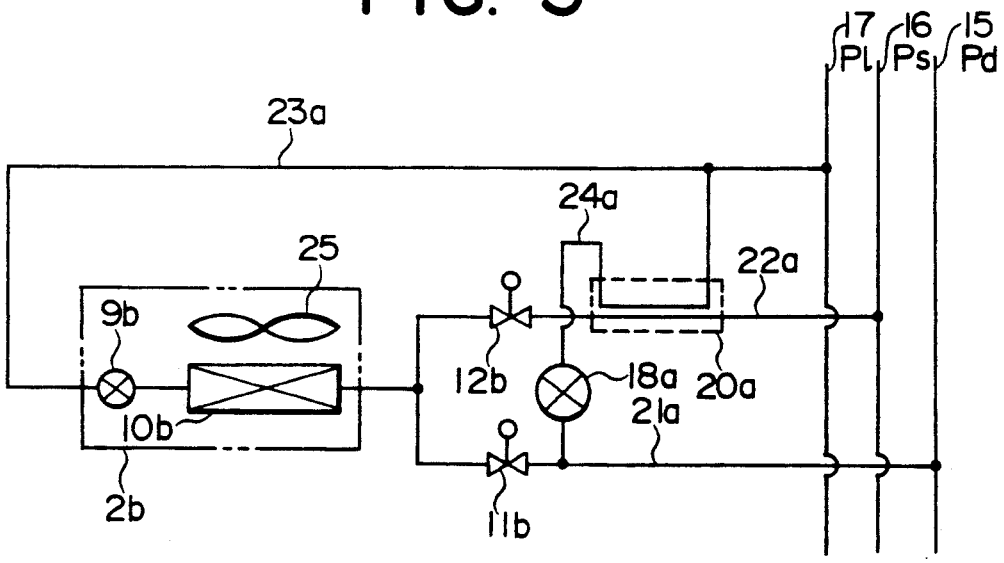
FIG. 3 is a schematic view showing an embodiment of the present invention.

As shown in FIG. 3, a heat exchange between the refrigerant in the bypass 24*a* and the refrigerant in the depressurized heated gas refrigerant path branch 22*a* may be carried out in a heat exchanger 20*a* so that the gas refrigerant flowing from the pressurized gas refrigerant path branch 21*a* to the pressurized liquid refrigerant path branch 23*a* through the bypass 24*a* can be liquefied by a low temperature of the refrigerant in the depressurized heated gas refrigerant path branch 22*a*.

Figure 4:
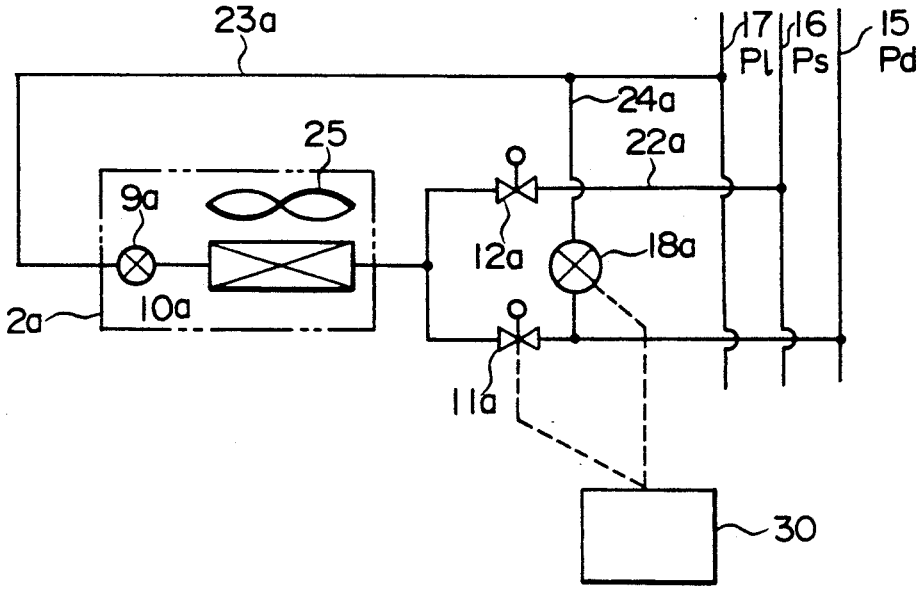
FIG. 4 is a schematic view showing an embodiment of the present invention.

As shown in FIG. 4, the second valve 18*a* may be controlled by a controller 30 according to the operation of the first valve 11*a* so that the second valve 18*a* is opened when a predetermined time has been elapsed after the refrigerant flow from the pressurized gas refrigerant path branch 21*a* into the second heat exchanger 10*a* had been cut off by the first valve 11*a*.

Figure 5:
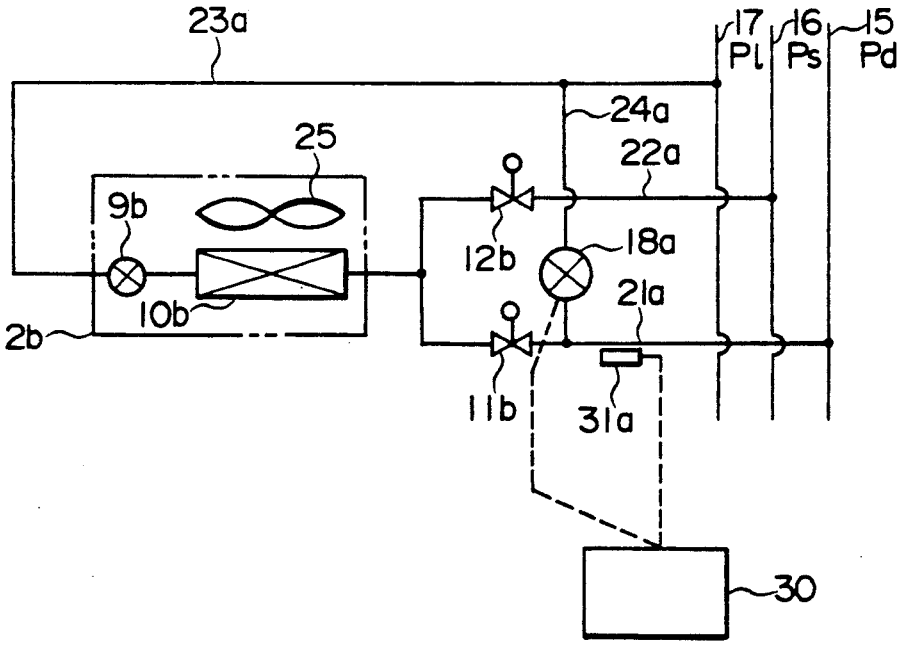
FIG. 5 is a schematic view showing an embodiment of the present invention.

As shown in FIG. 5, the second valve 18*a* may be controlled by the controller 30 according to the condition of the refrigerant in the pressurized gas refrigerant path branch 21*a* and/or the pressurized gas refrigerant path 15. The condition of the refrigerant in the pressurized gas refrigerant path branch 21*a* and/or the pressurized gas refrigerant path 15 is detected by a sensor 31 which can measure a decrease in temperature of the refrigerant in the pressurized gas refrigerant path branch 21*a* and/or the pressurized gas refrigerant path 15 or a generated value of the liquefied refrigerant in the pressurized gas refrigerant path branch 21*a* and/or the pressurized gas refrigerant path 15. When the measured temperature of the refrigerant reaches less than a predetermined temperature sufficient for liquefying the gas refrigerant, or when the measured value of the liquefied refrigerant reaches more than a predetermined value, the second valve 18*a* is opened. The sensor 31 may be a temperature sensor or a capacitance type level gauge.

Figure 6:
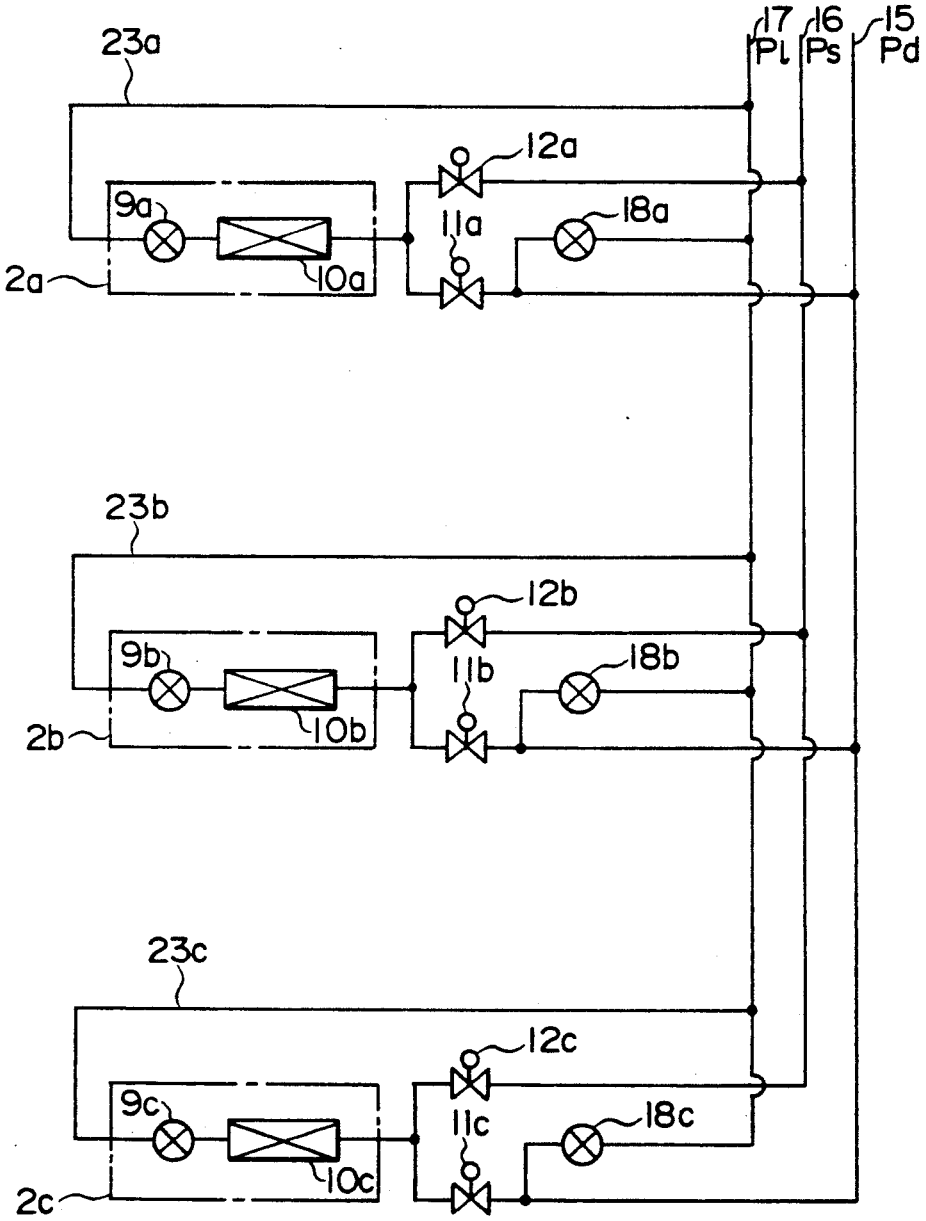
FIG. 6 is a schematic view showing an embodiment of the present invention.

In an embodiment as shown in FIG. 6, the refrigerant in the pressurized gas refrigerant path 15 flows into the pressurized liquid refrigerant path 17 without passing through the pressurized liquid refrigerant path branches 23*a*, 23*b*, 23*c*, when any of the first valves 11*a*, 11*b*, 11*c* is closed so that the refrigerant flow from the pressurized gas refrigerant path 15 to any of the second heat exchangers 10*a*, 10*b*, 10*c* is cut off.

Figure 7:
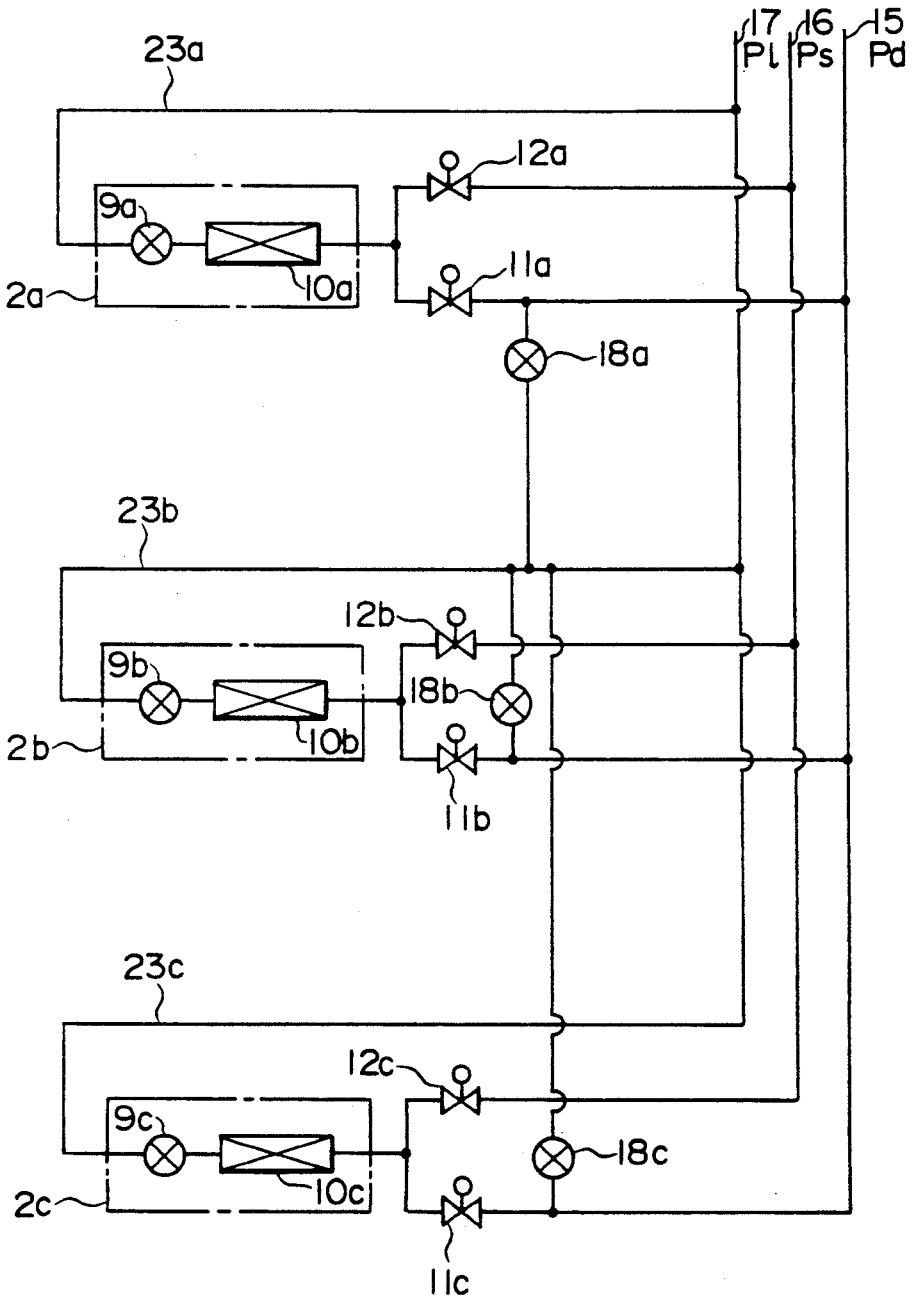
FIG. 7 is a schematic view showing an embodiment of the present invention.

In an embodiment as shown in FIG. 7, since a time in which the pressurized liquid refrigerant is supplied from the second heat exchanger 10*b* to the pressurized liquid refrigerant path 17 or supplied from the pressurized liquid refrigerant path 17 to the adiabatic expansion orifice 9*b* is significantly larger than a time in which the pressurized liquid refrigerant is supplied from the second heat exchanger 10*a* or 10*c* to the pressurized liquid refrigerant path 17 or supplied from the pressurized liquid refrigerant path 17 to the adiabatic expansion orifice 9*a* or 9*c*, the refrigerant in the pressurized gas refrigerant path 15 flows into the pressurized liquid refrigerant path 17 adjacently to the second heat exchanger 10*b* when the first valve 11*a* or 11*c* is closed.

Figure 8:
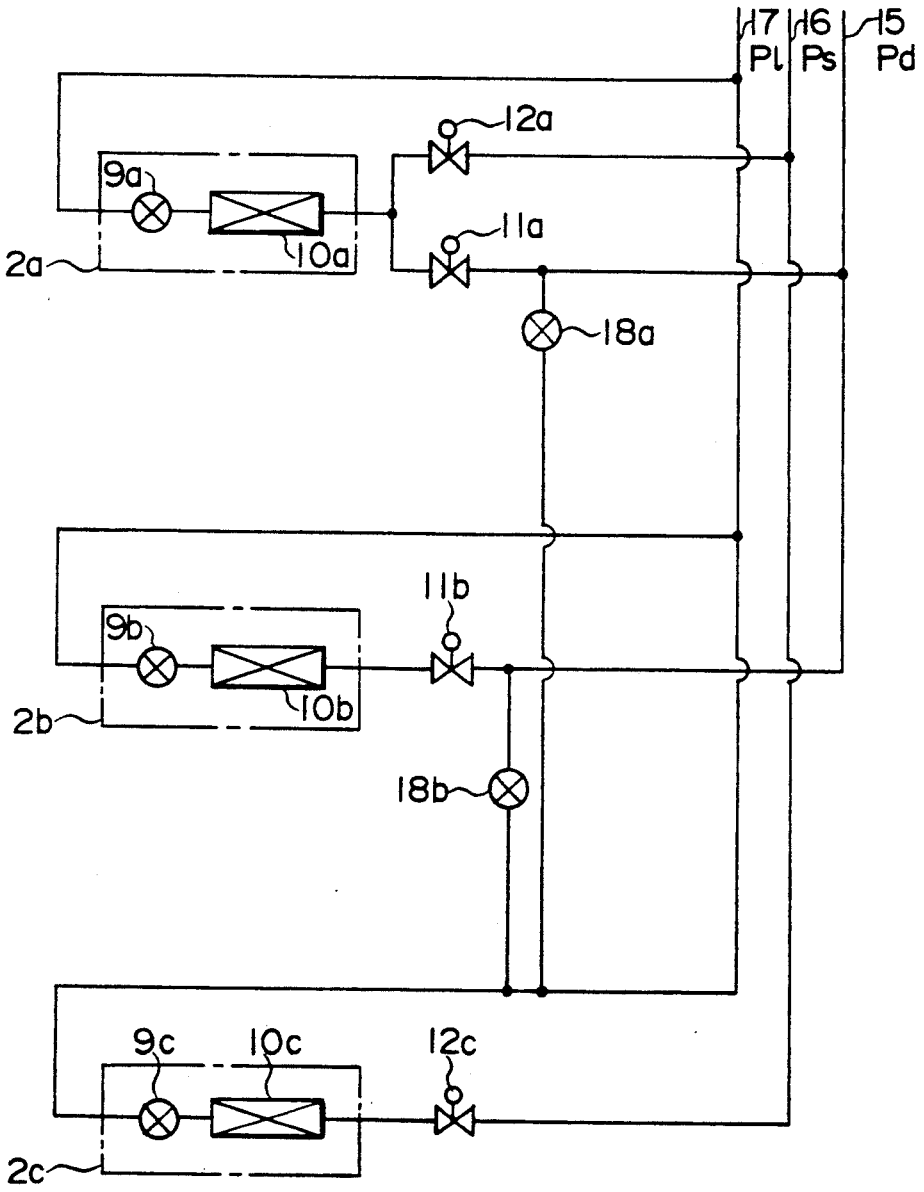
FIG. 8 is a schematic view showing an embodiment of the present invention.

In an embodiment as shown in FIG. 8, since a time in which the pressurized liquid refrigerant is supplied from the pressurized liquid refrigerant path 17 to the adiabatic expansion orifice 9*c* connected to the second heat exchanger 10*c* used only to heat the depressurized gas refrigerant is significantly larger than a time in which the pressurized liquid refrigerant is supplied from the second heat exchanger 10*a* or 10*b* to the pressurized liquid refrigerant path 17 or supplied from the pressurized liquid refrigerant path 17 to the adiabatic expansion orifice 9*a* or 9*b*, the refrigerant in the pressurized gas refrigerant path 15 flows into the pressurized liquid refrigerant path 17 adjacently to the second heat exchanger 10*c* when the first valve 11*a* or 11*b* is closed.

Figure 9:
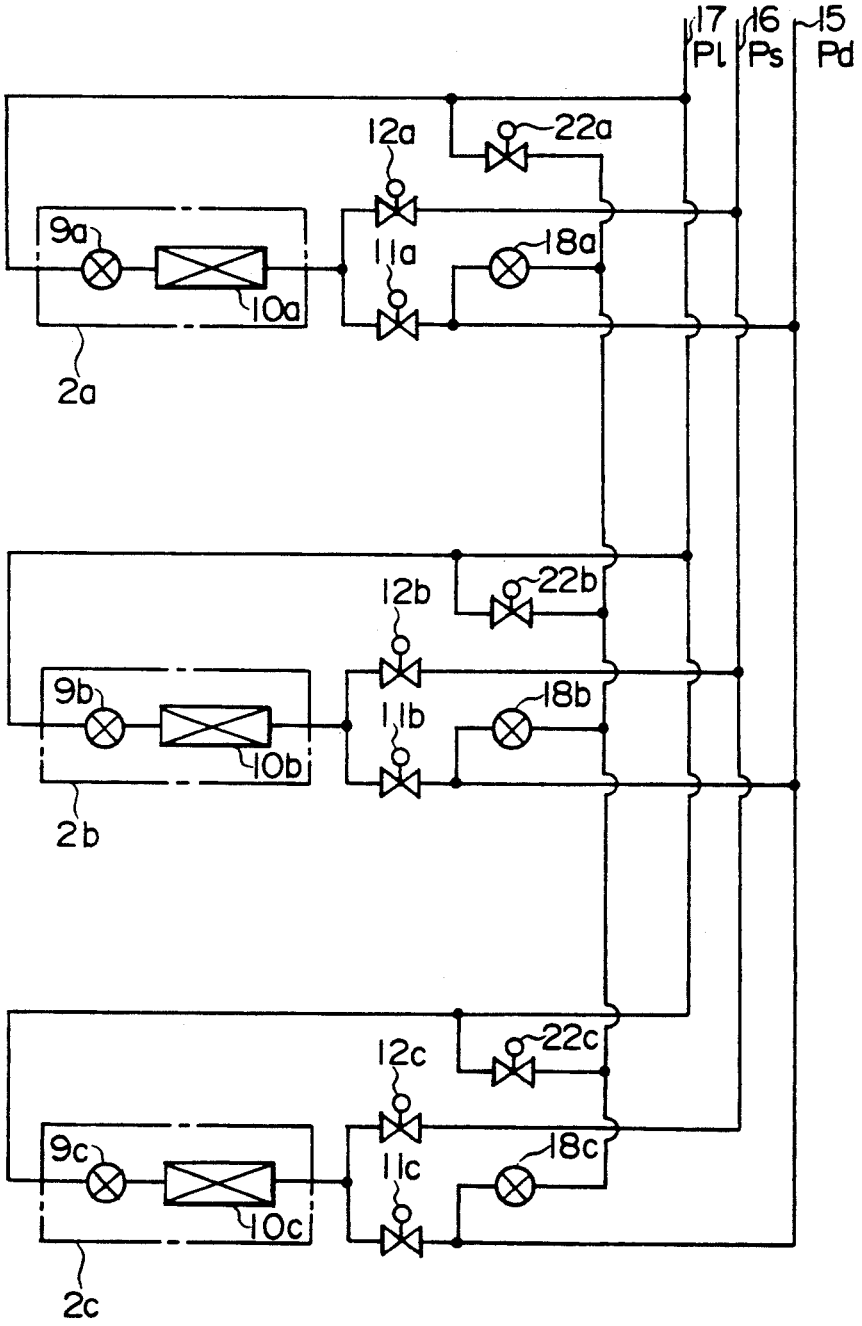
FIG. 9 is a schematic view showing an embodiment of the present invention.

In an embodiment as shown in FIG. 9, valves 22*a*, 22*b*, 22*c* are arranged between the pressurized liquid refrigerant path 17 and the second valves 18*a*, 18*b*, 18*c*. Any of the valves 22*a*, 22*b*, 22*c* connected to the pressurized liquid refrigerant path 17 adjacently to any of the second heat exchanger 10*a*, 10*b*, 10*c* which is operating to heat or cool the refrigerant is opened so that the refrigerant in the pressurized gas refrigerant path 15 flows into the pressurized liquid refrigerant path 17 adjacently to the second heat exchanger 10*c* when the first valve 11*a* or 11*b* or 11*c* is closed. However, any of the valves 22*a*, 22*b*, 22*c* connected to the pressurized liquid refrigerant path 17 adjacently to any of the second heat exchanger 10*a*, 10*b*, 10*c* which is not operating is closed.

Figure 10:
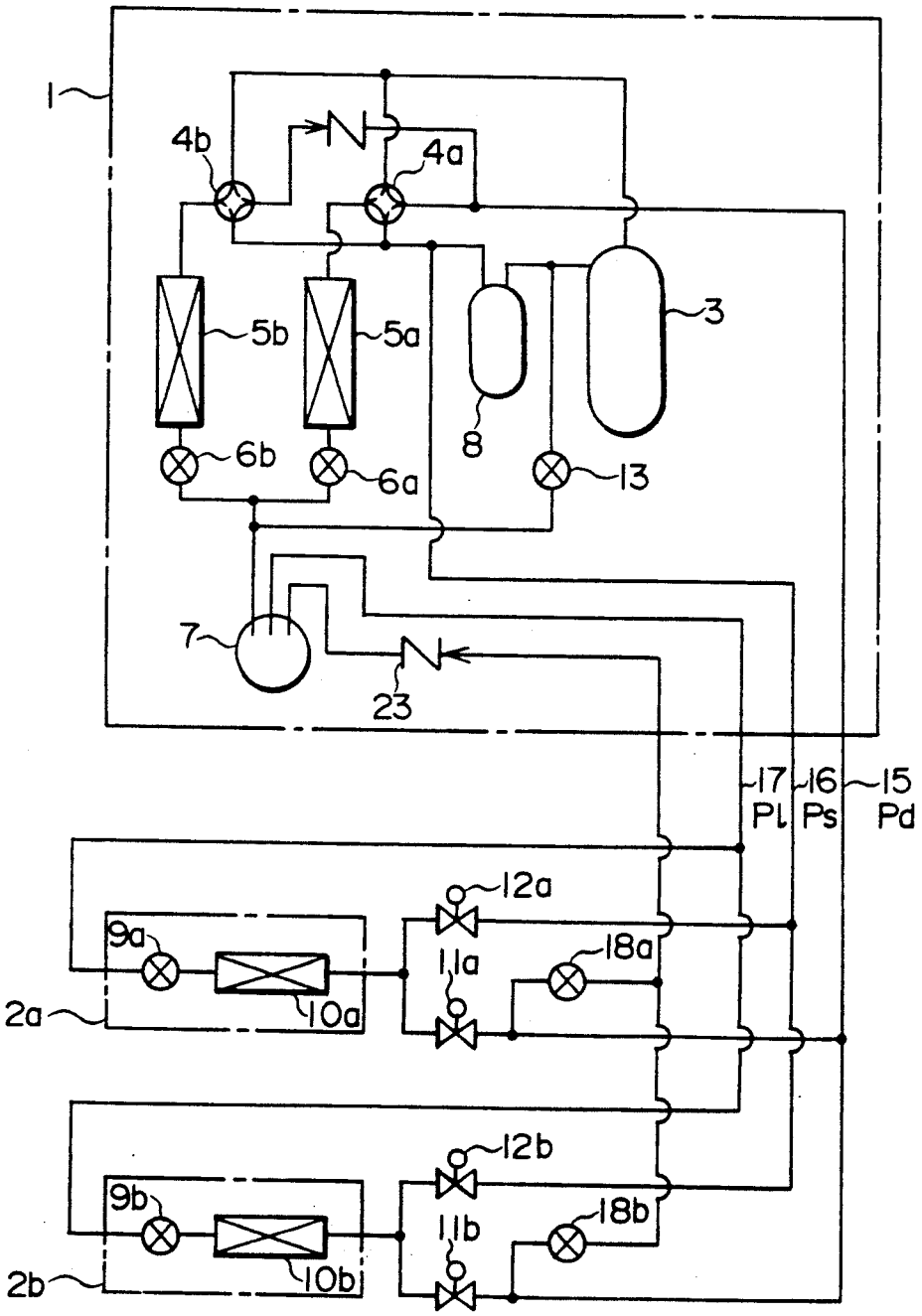
FIG. 10 is a schematic view showing an embodiment of the present invention.

In an embodiment as shown in FIG. 10, the second valves 18*a*, 18*b* is connected to the receiver 7 through an one-way valve 23 for allowing the refrigerant flow from the second valves 18*a*, 18*b* to the receiver 7 and preventing refrigerant flow from the receiver 7 to the second valves 18*a*, 18*b* so that the refrigerant from the second valves 18*a*, 18*b* flows into the pressurized liquid refrigerant path 17 through the receiver 7.

What is claimed is:

1. A refrigerant path apparatus comprising a pressurized gas refrigerant path for a flow of a pressurized gas refrigerant which has not been substantially cooled to be liquefied, a pressurized liquid refrigerant path for a flow of a pressurized liquid refrigerant which is generated from the pressurized gas refrigerant by being cooled to be liquefied, a first heat exchanger means which is fluidly connected to the pressurized gas refrigerant path to supply the pressurized gas refrigerant into the first heat exchanger so that a heat exchange is carried out between the pressurized gas refrigerant in the first heat exchanger and the outside of the first heat exchanger, a first valve means arranged between the first heat exchanger means and the pressurized gas refrigerant path to control the supply of the pressurized gas refrigerant from the pressurized gas refrigerant path into the first heat exchanger means, and a second valve means arranged between the pressurized gas refrigerant path and the pressurized liquid refrigerant path to allow a flow of the refrigerant from the pressurized gas refrigerant path to the pressurized liquid refrigerant path when the first valve means prevents the supply of the pressurized gas refrigerant from the pressurized gas refrigerant path into the first heat exchanger means.

2. A refrigerant path apparatus according to claim 1, wherein the refrigerant path apparatus further comprises a second heat exchanger means into which the pressurized gas refrigerant is supplied from the pressurized gas refrigerant path to cool and liquefy the pressurized gas refrigerant by a heat exchanging between the pressurized gas refrigerant in the second heat exchanger means and the outside of the second heat exchanger means so that the pressurized liquid refrigerant is supplied from the second heat exchanger means to the pressurized liquid refrigerant path.

3. A refrigerant path apparatus according to claim 1, wherein the refrigerant path apparatus further comprises an adiabatic expansion orifice, a depressurized and heated gas refrigerant path for a flow of a depressurized and heated gas refrigerant, and a third valve means arranged between the first heat exchanger means and the depressurized and heated gas refrigerant path, wherein the third valve means opens to allow a flow of the refrigerant from the first heat exchanger means to the depressurized and heated gas refrigerant path, the pressurized liquid refrigerant is supplied from the pressurized liquid refrigerant path to the adiabatic expansion orifice, the pressurized liquid refrigerant is changed to a depressurized gas refrigerant by an adiabatic expansion at the adiabatic expansion orifice, the depressurized gas refrigerant is supplied from the adiabatic expansion orifice to the first heat exchanger means, the depressurized gas refrigerant is heated to be changed to the depressurized and heated gas refrigerant by a heat exchanging between the depressurized gas refrigerant in the first heat exchanger means and the outside thereof, and the depressurized and heated gas refrigerant flows from the first heat exchanger means through the third valve means to the depressurized and heated gas refrigerant path, when the first valve means is closed to prevent the supply of the pressurized gas refrigerant from the pressurized gas refrigerant path into the first heat exchanger means.

4. A refrigerant path apparatus according to claim 1, wherein the pressurized liquid refrigerant generated from the pressurized gas refrigerant which is supplied from the pressurized gas refrigerant path to the first heat exchanger means and is cooled and liquefied to be changed to the pressurized liquid refrigerant at the first heat exchanger means is supplied from the first heat exchanger means to the pressurized liquid refrigerant path, when the first valve means opens to allow the supply of the pressurized gas refrigerant from the pressurized gas refrigerant path into the first heat exchanger means.

5. A refrigerant path apparatus according to claim 1, wherein the refrigerant path apparatus further comprises an adiabatic expansion orifice, a depressurized and heated gas refrigerant path for a flow of a depressurized and heated gas refrigerant, and a third heat exchanger means, wherein the pressurized liquid refrigerant is supplied from the pressurized liquid refrigerant path to the adiabatic expansion orifice, the pressurized liquid refrigerant is changed to a depressurized gas refrigerant by an adiabatic expansion at the adiabatic expansion orifice, the depressurized gas refrigerant is supplied from the adiabatic expansion orifice to the third heat exchanger means, the depressurized gas refrigerant is heated to be changed to the depressurized and heated gas refrigerant by a heat exchanging between the depressurized gas refrigerant in the third heat exchanger means and the outside thereof, and the depressurized and heated gas refrigerant flows from the third heat exchanger means to the depressurized and heated gas refrigerant path.

6. A refrigerant path apparatus according to claim 1, wherein the pressurized gas refrigerant path and the pressurized liquid refrigerant path are connected to each other through the second valve means adjacently to the first valve means.

7. A refrigerant path apparatus according to claim 1, wherein the first heat exchanger means is connected to the pressurized gas refrigerant path by the first valve means arranged adjacently to the first heat exchanger means.

8. A refrigerant path apparatus according to claim 1, wherein the pressurized gas refrigerant path and the pressurized liquid refrigerant path are connected to each other through the second valve means adjacently to the first heat exchanger means.

9. A refrigerant path apparatus according to claim 1, wherein the pressurized gas refrigerant path and the pressurized liquid refrigerant path are connected to each other through the second valve means and a receiver for storing the pressurized liquid refrigerant.

10. A refrigerant path apparatus according to claim 1, wherein the second valve means includes an one way valve for allowing a refrigerant flow from the pressurized gas refrigerant path to the pressurized liquid refrigerant path and preventing the refrigerant flow from the pressurized liquid refrigerant path to the pressurized gas refrigerant path.

11. A refrigerant path apparatus according to claim 1, wherein the second valve means includes a pump means for feeding compulsorily the refrigerant from the pressurized gas refrigerant path to the pressurized liquid refrigerant path.

12. A refrigerant path apparatus according to claim 1, wherein the second valve means allows a refrigerant flow from the pressurized gas refrigerant path to the pressurized liquid refrigerant path when a predetermined time has elapsed after the first valve means had stopped the supply of the pressurized gas refrigerant from the pressurized gas refrigerant path into the first heat exchanger means.

13. A refrigerant path apparatus according to claim 1, wherein the second valve means allows a refrigerant flow from the pressurized gas refrigerant path to the pressurized liquid refrigerant path when the pressurized liquid refrigerant which is generated from the pressurized gas refrigerant by being cooled to be liquefied exists in the pressurized gas refrigerant path.

14. A refrigerant path apparatus according to claim 1, wherein the second valve means allows a refrigerant flow from the pressurized gas refrigerant path to the pressurized liquid refrigerant path when a temperature in the pressurized gas refrigerant path is sufficiently low for liquefying the pressurized gas refrigerant.

15. A refrigerant path apparatus according to claim 3, wherein the first heat exchanger means includes a plurality of first heat exchangers, the second valve means includes a plurality of second valves, the refrigerant path apparatus further comprises a plurality of fourth valves arranged respectively between the second valves and the pressurized liquid refrigerant path so that any of the fourth valves opens to allow a refrigerant flow from the any of the second valves to the pressurized liquid refrigerant path.

16. A refrigerant path apparatus according to claim 3, wherein the refrigerant path apparatus further comprises a fourth heat exchanger means at which a heat exchange between a refrigerant flow from the pressurized gas refrigerant path to the pressurized liquid refrigerant path through the second valve means and the refrigerant flow in the depressurized and heated gas refrigerant path is carried out.

17. A method for controlling a refrigerant path apparatus including a pressurized gas refrigerant path for a flow of a pressurized gas refrigerant which has not been substantially cooled to be liquefied, a pressurized liquid refrigerant path for a flow of a pressurized liquid refrigerant which is generated from the pressurized gas refrigerant by being cooled to be liquefied, a first heat exchanger means which is fluidly connected to the pressurized gas refrigerant path to supply the pressurized gas refrigerant into the first heat exchanger so that a heat exchange is carried out between the pressurized gas refrigerant in the first heat exchanger and the outside of the first heat exchanger, comprising the steps of allowing a flow of the refrigerant from the pressurized gas refrigerant path to the pressurized liquid refrigerant path when a supply of the pressurized gas refrigerant from the pressurized gas refrigerant path into the first heat exchanger means is prevented, and preventing the flow of the refrigerant from the pressurized gas refrigerant path to the pressurized liquid refrigerant path when the supply of the pressurized gas refrigerant from the pressurized gas refrigerant path into the first heat exchanger means is allowed.

18. A method according to claim 17, wherein the refrigerant flow from the pressurized gas refrigerant path to the pressurized liquid refrigerant path is allowed when a predetermined time has elapsed after the supply of the pressurized gas refrigerant from the pressurized gas refrigerant path into the first heat exchanger means had been stopped.

19. A method according to claim 17, wherein the refrigerant flow from the pressurized gas refrigerant path to the pressurized liquid refrigerant path is allowed when the pressurized liquid refrigerant which is generated from the pressurized gas refrigerant by being cooled to be liquefied exists in the pressurized gas refrigerant path.

20. A method according to claim 17, wherein the refrigerant flow from the pressurized gas refrigerant path to the pressurized liquid refrigerant path is allowed when a temperature in the pressurized gas refrigerant path is sufficiently low for liquefying the pressurized gas refrigerant.

* * * * *